US011790765B1

(12) United States Patent
Wolf et al.

(10) Patent No.: US 11,790,765 B1
(45) Date of Patent: Oct. 17, 2023

(54) SMOKE DETECTOR DEVICE WITH SECONDARY DETECTION CHAMBER AND FILTER

(71) Applicant: Honeywell International Inc., Charlotte, NC (US)

(72) Inventors: Benjamin H. Wolf, Leicester (GB); Michael Barson, Nuneaton (GB); Christopher Dearden, Melton Mowbray (GB)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 17/878,254

(22) Filed: Aug. 1, 2022

(51) Int. Cl.
*G08B 29/14* (2006.01)
*G08B 17/107* (2006.01)

(52) U.S. Cl.
CPC ..... *G08B 29/145* (2013.01); *G08B 17/107* (2013.01)

(58) Field of Classification Search
CPC ..... G08B 29/145; G08B 17/107
See application file for complete search history.

(56) References Cited

U.S. PATENT DOCUMENTS 4,282,520 A * 8/1981 Shipp ..... G08B 29/181 340/629
4,617,560 A * 10/1986 Gutmann ..... G08B 17/10 340/630
4,906,978 A * 3/1990 Best ..... G08B 17/107 340/630
5,139,699 A * 8/1992 Cooper ..... G08B 29/145 516/8
6,225,910 B1 * 5/2001 Kadwell ..... G08B 29/043 340/630
7,669,457 B2 3/2010 Griffith et al.
8,624,745 B2 1/2014 Barson
10,783,771 B2 * 9/2020 Penney ..... G08B 29/145
11,615,699 B2 * 3/2023 Penney ..... G08B 29/145 340/515
11,662,302 B2 * 5/2023 Guler ..... G01N 21/53 250/252.1
2001/0038338 A1 * 11/2001 Kadwell ..... G08B 29/24 340/630
2003/0020617 A1 * 1/2003 Tice ..... G08B 29/183 340/521

(Continued)

FOREIGN PATENT DOCUMENTS

EP 2320397 B1 5/2012
JP 2019070992 A 5/2019

*Primary Examiner* — Curtis J King
(74) *Attorney, Agent, or Firm* — Brooks, Cameron & Huebsch, PLLC

(57) ABSTRACT

Devices, systems, and methods for providing a smoke detector device with a secondary detection chamber and filter are described herein. One smoke detector device includes a first smoke detecting chamber, a first light source, a first light sensor, an air movement device to move at least some of the particulate into an inlet of a second smoke detecting chamber, a filter material positioned such that the particulate must pass through the filter material to enter the second chamber, the second chamber formed therein to receive particulate from the first chamber, a second light source, and a second light sensor to determine whether smoke particles are present in the second chamber.

20 Claims, 2 Drawing Sheets

(56) References Cited

U.S. PATENT DOCUMENTS

| | | | | |
|---|---|---|---|---|
| 2005/0173638 | A1* | 8/2005 | Powell | G01N 21/0303 250/341.1 |
| 2005/0219045 | A1* | 10/2005 | Ito | G08B 29/145 340/506 |
| 2012/0140231 | A1* | 6/2012 | Knox | G01N 15/1434 356/442 |
| 2012/0171987 | A1* | 7/2012 | Newman | G08B 25/08 455/404.1 |
| 2013/0258335 | A1* | 10/2013 | Kato | G08B 29/145 356/338 |
| 2014/0015668 | A1* | 1/2014 | Hanses | G08B 29/24 340/630 |
| 2015/0096351 | A1* | 4/2015 | Orsini | G01N 21/53 73/28.01 |
| 2015/0302727 | A1* | 10/2015 | Piccolo, III | G08B 17/107 340/514 |
| 2017/0287318 | A1* | 10/2017 | Moffa | G08B 29/043 |
| 2019/0266868 | A1* | 8/2019 | Patel | G08B 17/107 |
| 2019/0287364 | A1* | 9/2019 | Birnkrant | G01N 21/31 |
| 2021/0065536 | A1* | 3/2021 | Dearden | G08B 29/145 |

* cited by examiner

SMOKE DETECTOR DEVICE WITH SECONDARY DETECTION CHAMBER AND FILTER

TECHNICAL FIELD

The present disclosure relates to smoke detector devices, systems, and methods having a secondary detection chamber and filter.

BACKGROUND

Fire alarm systems alert occupants of a building that there is a fire and that they should leave the building until emergency personnel can extinguish the fire and deem the building safe to return. One of the biggest causes in people 'losing faith' in the alarm being raised is when they have suffered from false alarms.

For example, in apartment complexes, the residents will all have to leave their apartments and muster outside the building. Also, at a manufacturing facility, production lines will need to be shut down while workers leave the building. Both such instances can be impactful on a person's life and negatively impact their faith in the alarm system.

In many instances, the local fire service may even fine the building owner when being incorrectly called out to an event. Accordingly, avoiding false alarms and restoring faith in the alarm system are key goals for any building owner.

A standard photo detector designed smoke detector device and even a dual angle optical detector can still struggle with many different items that enter the detector and can confuse steam, dust, and insects (for example) with real smoke. Aspirating smoke detectors (ASD), which filter the smoke before making a fire decision are very good at filtering out non-fire particulates in order to make a better informed fire decision. However, these are expensive to install and maintain and so are often only used in data centers, at high heights, or in particularly harsh environments. Customers would like the simplicity of using standard point detectors but without the complexity and cost associated with ASD.

DETAILED DESCRIPTION

Figure 1:
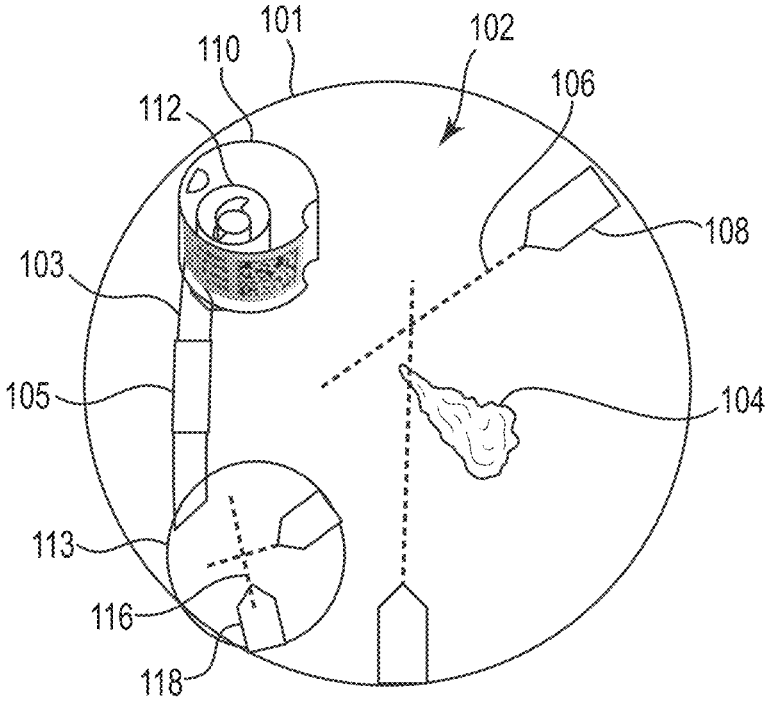
FIG. 1 is an overhead view illustration of a smoke detection chamber of a smoke detector device in accordance with one or more embodiments of the present disclosure.

Smoke detector devices, systems, and methods for providing a secondary detection chamber and filter in a smoke detector device of a fire alarm system are described herein. In the present disclosure, an air movement device can be utilized to move particulate from a first detection chamber through a filter and into a second detection chamber. Such a structure can reduce or eliminate false alarms which can be beneficial to the manufacturer and the building owner into which the smoke detector device is installed.

For example, one smoke detector device includes a first smoke detecting chamber, a first light source, a first light sensor, an air movement device to move at least some of the particulate into an inlet of a second smoke detecting chamber, a filter material positioned such that the particulate must pass through the filter material to enter the second chamber, the second chamber formed therein to receive particulate from the first chamber, a second light source, and a second light sensor to determine whether smoke particles are present in the second chamber.

Embodiments of the present disclosure can be utilized in self-test equipped devices and non-self-test equipped devices. Regarding self-test equipped devices, traditionally, service of fire alarm event devices included a first user (e.g., such as a technician, engineer, etc.) walking around the facility and visually checking the alarm system components, typically, at the same time as they carry out functional testing of event devices and other components of the alarm system.

Self-test devices are configured to initiate a smoke detection test from a remote device. Self-test devices include a smoke release apparatus that generates particulate similar to smoke particles from an actual fire event and uses the generated particulate to perform a test of the smoke detector device. Self-test device equipped systems can reduce the time it takes to test a fire system and reduce the workforce needed to test the system.

As discussed herein, self-testing devices and non-self-test devices can be less effective when there are lots of false alarms due to other items (e.g., dust, steam, insects) scattering the light from the light beam passing through the smoke detecting chamber. This can also be referred to as scattering the light upon the scattering path within the scattering chamber. Accordingly, the embodiments of the present disclosure allow for mitigation of many false alarm issues, thereby improving the ability for the fire alarm device to perform reliably.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 101 may reference element "01" in FIG. 1, and a similar element may be referenced as 201 in FIG. 2.

As used herein, "a", "an", or "a number of" something can refer to one or more such things, while "a plurality of" something can refer to more than one such things. For example, "a number of components" can refer to one or more components, while "a plurality of components" can refer to more than one component.

FIG. 1 is an overhead view illustration of a smoke detection chamber of a smoke detector device in accordance with one or more embodiments of the present disclosure. As illustrated in FIG. 1, a smoke detector device has a first smoke detecting chamber 101 having an interior space 102 wherein a light source 108 projects a light beam 106 through the chamber and a portion of the light beam is received by a receiver (e.g., light receiver 209 of FIG. 2A).

The smoke detector device also has an air movement device 110, a conduit 103, and filter material 105. The conduit connects the first detecting chamber to a second smoke detecting chamber 113 wherein a light source 118 projects a light beam 116 through the chamber to detect particulate within the second detecting chamber 113.

In the space 102 of first chamber 101, the chamber has a cloud of particulate 104. This particulate 104 can be smoke from a fire in the building or non-smoke particulate, such as dust, steam, or insects or other particles that may be present in the air within the building. As it is the goal of the smoke detector device to detect smoke from a fire within the building, any conditions within the smoke detecting chamber wherein the non-smoke particles trigger a false alarm should be eliminated, if possible.

With regard to self-test devices, a test particulate (e.g., an aerosol) release apparatus (i.e., movement component) is positioned such that when the self-test is initiated, it produces a particulate similar to smoke from a fire that travels through the smoke detecting chamber to allow the optical detectors (utilizing the light source and light beam projected therefrom) to be tested to make sure they can detect smoke. In some embodiments, the particulate is created by the heating of a wax material (e.g., a solid, paraffin wax material) wherein the wax material is melted and produces the particulate.

In some embodiments, the self-test module functionalities can all be provided on a circuit board chip that can be installed into smoke detector devices by the manufacturer or after manufacture as an upgrade to a legacy smoke detector device that was not manufactured with self-test capabilities. In some embodiments of the present disclosure, this self-test circuit board chip can also include the filter material 105 (tube 103) and second smoke detecting chamber 113 and its sensing components. In some non-self-test embodiments, a circuit board having the first chamber and sensing components thereon can also include the second chamber and its sensing components and the filter material provided thereon.

An example of a test particulate release apparatus is shown in FIG. 1. It is constructed of an outer housing 110 that forms a space inside the component. This space can include a test smoke generating apparatus. For example, within the space, a heater can be positioned for melting the wax to release the self-test particulate (e.g., test smoke) used in the self-test process as discussed above.

The space can also include an air movement device (e.g., a fan) 112, located within the space, in a conduit between the space and the chamber (e.g., conduit 207 of FIGS. 2A and 2B), or within the chamber 101, for directing the self-test particulate out of the space and into the smoke detecting chamber 101. The air movement device can be located within the smoke detecting chamber 101 or in air communication therewith to move the self-test particulate from the space within the air movement device into the smoke detecting chamber 101.

However, in embodiments of the present disclosure, the fan can also be used to move the particulate out of the chamber and/or smoke detector device once the self-test process has been completed and can move at least a portion of the particulate toward the second detecting chamber. In non-self-test embodiments, the air movement device can just be a fan or other apparatus that can be used to direct or pull the particulate toward the second detecting chamber.

The process for moving particulate toward the second detecting chamber can be initiated at any time during operation of the smoke detector device. For example, the process can be initiated periodically on a schedule (e.g., monthly), triggered when the first detecting chamber sensing components detect a potential fire condition based on potential smoke particles being present in the first detecting chamber, can be initiated in conjunction with another process (e.g., in conjunction with a self-testing process), or can be initiated by a technician that is either on site or remote.

For instance, the smoke detector device can include a processor and memory and can execute instructions via the processor that are stored in the memory to determine whether initiate the movement process. The determination of whether to initiate the movement process can be accomplished, for example, based on one or more calendar dates, time periods, and/or light sensor data as discussed herein. Such a determination can be accomplished by a processor on the smoke detector device, another smoke detector device (wherein a master device determines initiation on one or more slave devices), an alarm system control panel, and/or a remote device (handheld device used by a technician in the building or a monitoring system device located remotely from the building).

The smoke detector device can include a processor and memory, wherein the processor executes instructions stored in the memory to accomplish certain smoke detector device tasks, such as initiating a self-test or particulate movement process, detecting whether there is smoke in the chamber, determining if the particulate in the chamber is test particulate or an insect, and other normal smoke detector device functions. Initiation of an particulate movement process can be accomplished through executable instructions that are executed by the processor to provide scheduling or can user input via any of these devices through a user interface associated with one of the computing devices.

The smoke detector device can be connected to a fire system control panel, other computing components (e.g., computing device), or directly to a network access device, which is connected to one or more remote computing devices. The remote computing device can be, for example, a mobile device that is used by a technician within the building and communicates, at least in part, through a gateway device of the local fire alarm system. The remote device can also be a computing device at a remote monitoring location wherein one or more fire alarm systems are monitored for alarms and are tasked with coordinating a response to the alarm (e.g., coordinating first responders, contacting building owner/management, etc.).

The memory can be any type of storage medium that can be accessed by the processor to perform various examples of the present disclosure. For example, the memory can be a non-transitory computer readable medium having computer readable instructions (e.g., executable instructions/computer program instructions) stored thereon that are executable by the processor for event device maintenance in accordance with the present disclosure. The computer readable instructions can be executable by the processor to provide the initiation and conducting of a particulate movement and secondary detecting chamber smoke particulate detection process.

The memory can be volatile or nonvolatile memory. The memory can also be removable (e.g., portable) memory, or non-removable (e.g., internal) memory. For example, the memory can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Further, although memory is discussed as being located within the smoke detector device, embodiments of the present disclosure are not so limited. For example, memory can also be located internal to another computing resource (e.g., enabling computer readable instructions to be downloaded over the Internet or another wired or wireless connection).

As discussed above, a user (e.g., operator) can interact with the smoke detector device via user interface. For example, a user interface can provide (e.g., display and/or present) information to the user, and/or receive information from (e.g., input by) the user. For instance, in some embodiments, user interface can be a graphical user interface (GUI) that can provide and/or receive information to and/or from the user.

The display can be, for instance, a touch-screen (e.g., the GUI can include touch-screen capabilities). Alternatively, a display can include a television, computer monitor, mobile device screen, other type of display device, or any combination thereof, connected to the computing device and configured to receive a video signal output.

In some embodiments, the processor and memory can be in the form of a controller that controls a number of functions of the insecticide injection process, the self-testing process, and/or the smoke detection process. For example, the controller can execute instructions with the processor that are stored in memory to receive data regarding the portion of the light beam received by a light sensor associated with the smoke detector chamber and analyzes the data to determine whether smoke particles are present in the chamber or whether there are non-smoke particles in the chamber.

Other functions can, for example, include: wherein the controller initiates melting of a solid self-test material, wherein the controller initiates actuation of a fan apparatus to move the particulate toward the second detecting chamber, and/or wherein the controller initiates a second actuation of the fan after a predetermined time to move the particulate out of the first and/or second chambers. For example, the second chamber can include an exit that allows air in the second chamber to be expelled either back into the first chamber or outside of the detector device. Additionally, this exit can also include a filter material to filter out particulate before the air is expelled.

Further, in some embodiments, the smoke detector device can include a self-test apparatus that generates self-test particulate. In some such embodiments, the smoke detector device also includes a controller having a processor and memory and wherein the memory includes instructions executable by the processor to test continued functioning of the filter by checking for blockages through passing self-test test particulate through the filter to the secondary detection chamber to determine if the second light sensor can sense a threshold amount of self-test particulate.

As discussed herein, in some embodiments, the air movement device may be a part of the particulate release apparatus. In some such embodiments, the air movement device may be operated while the test smoke generating components are not functioning.

As an additional example, the user interface can include a keyboard and/or mouse the user can use to input information. Embodiments of the present disclosure, however, are not limited to a particular type(s) of user interface.

Figure 2A:
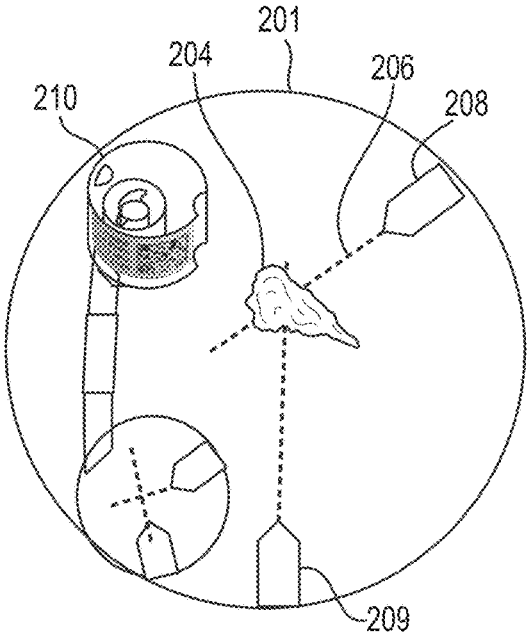
FIGS. 2A-2D are an example of a smoke detector device filtering process in accordance with one or more embodiments of the present disclosure.

FIGS. 2A-2D are an example of a smoke detector device filtering process in accordance with one or more embodiments of the present disclosure. In FIG. 2A, a cloud of particulate 204 has entered the first detecting chamber 201 and is being sensed by receipt of a portion of light beam 206 from light source 208 by light receiver 209.

Figure 2B:
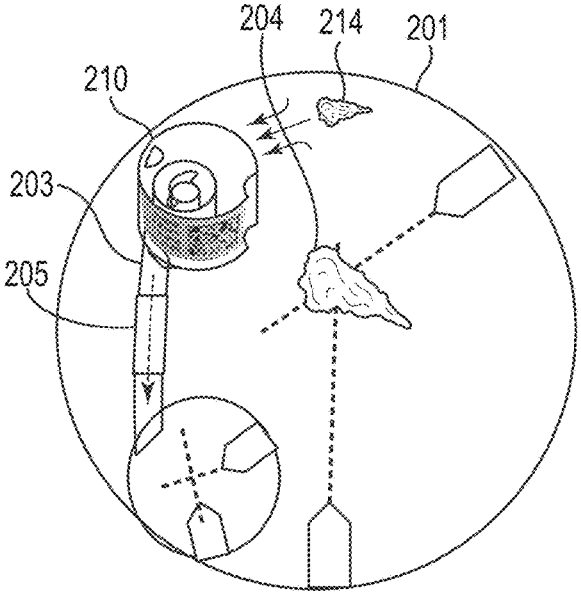

In FIG. 2B, the air movement device 210 has been actuated and is directing at least a portion 214 of the particulate cloud 204 toward a first end of conduit 203. In some embodiments, the conduit 203 can be made up of two parts each having two ends with one end attached to one chamber and the other end attached to a filtering chamber that houses the filtering material 205.

Figure 2C:
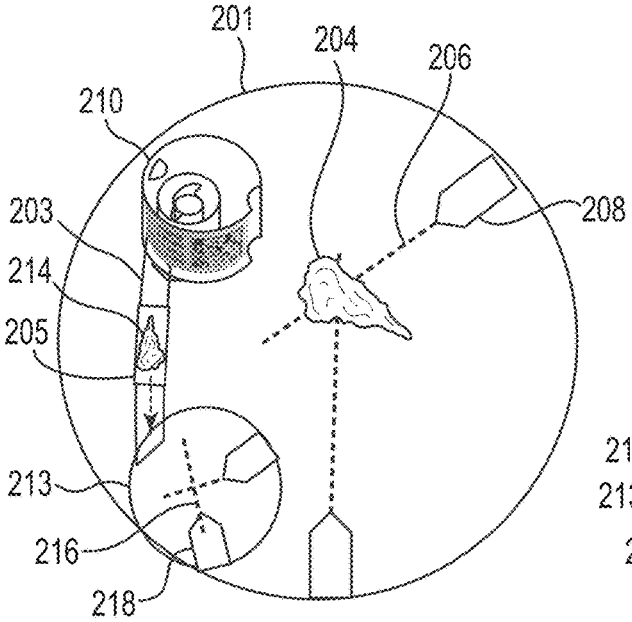

FIG. 2C depicts the portion of the cloud of particulate passing through the conduit 203 and filter material 205. If the particulate is too large for the pore size of the apertures within the filter material, the particulate will not be able to enter the filter material or will get stuck within the material.

For example, if the filter material has pore size to not allow particles larger than 3 microns to pass through the filter material, then most non-smoke particles will not be able to pass through the filter material. Accordingly, even most dust particles or steam droplets cannot to pass through the filter material as their pores size is typically larger than 3 microns. In another example, if the filter material has pore size to not allow particles larger than 10 microns to pass through the filter material, then smoke and dust particles may pass through, but insects will not be able to pass through the filter material.

Note that a ratio of the response of the first chamber to the filtered second chamber can be used to increase the effectiveness of the filter. Specifically, the ratio changes as the mean particle size moves toward the filter's nominal threshold size and this can be recognized by executable software instructions at the controller.

Figure 2D:
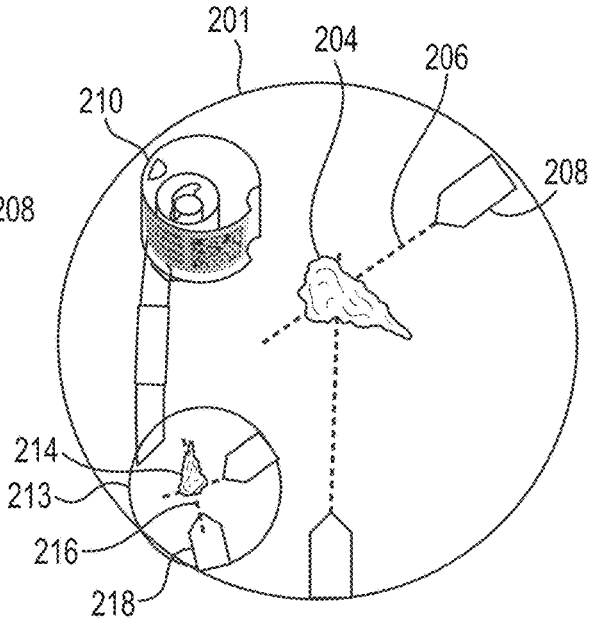

If the particulate is smaller than the pore size of the apertures within the filter material, the particulate will be able to pass through the filter material and out of the conduit into the second detecting chamber 213 as shown in FIG. 2D. The remaining particulate 214 can then be sensed by the second light beam 216 from light source 218 to determine whether there is smoke particulate in the second detecting chamber.

Provided below are two additional examples of embodiments of the present disclosure. In a first embodiment, a smoke detector device, includes a first smoke detecting chamber formed therein to receive particulate, a first light source directing a first light beam through the first smoke detecting chamber, and a first light sensor to receive a portion of the first light beam and analyze the received first light beam to determine whether particles are present in the first smoke detecting chamber. The embodiment also includes an air movement device to move at least some of the particulate into an inlet of a second smoke detecting chamber, a filter material sized to filter particulate larger than a smoke particle and positioned such that the particulate must pass through the filter material to enter a second smoke detecting chamber thereby restricting passage of particles larger than smoke particles through the filter material. The second smoke detecting chamber is formed therein to receive particulate from the first smoke detecting chamber and has a second light source directing a second light beam through the second smoke detecting chamber and a second light sensor to receive a portion of the second light beam and analyze the received second light beam to determine whether smoke particles are present in the second smoke detecting chamber.

In the second example embodiment, the smoke detector device, includes a first smoke detecting chamber formed therein to receive particulate, a first light source directing a first light beam through the first smoke detecting chamber and a first light sensor to receive a portion of the first light beam and analyze the received first light beam to determine whether particles are present in the first smoke detecting chamber.

The embodiment also includes an air movement device provided in the first detecting chamber to move at least some of the particulate into an inlet of a second smoke detecting chamber, a filter material positioned such that the particulate must pass through the filter material to enter a second smoke detecting chamber, the second smoke detecting chamber formed therein to receive particulate from the first smoke detecting chamber, a second light source directing a second light beam through the second smoke detecting chamber, and a second light sensor to receive a portion of the second light beam and analyze the received second light beam to determine whether smoke particles are present in the second smoke detecting chamber. As with the other examples above these embodiments include a second chamber and a filter material.

In this manner, non-smoke particulate can be reduced or eliminated in the second detector chamber. Accordingly, the embodiments of the present disclosure reduce the amount of false alarms, thereby, increasing the reliability of the devices and customer satisfaction.

As discussed herein, the embodiments of the present disclosure can be beneficial in providing reduced insect interference with smoke detection. Such embodiments can reduce technician time and the number of skilled technicians on site, among other benefits.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A smoke detector device, comprising:
- a first smoke detecting chamber;
- a first light source;
- a first light sensor;
- an air movement device to move a sample of any particulates in the chamber into a second smoke detecting chamber;
- a filter material positioned such that the particulate must pass through the filter material to enter the second chamber;
- the second chamber formed therein to receive particulate from the first chamber;
- a second light source; and
- a second light sensor to determine whether smoke particles are present in the second chamber.

2. The smoke detector device of claim 1, wherein the air movement device is a fan.

3. The smoke detector device of claim 1, wherein the air movement device is part of a self-test apparatus of the smoke detector device.

4. The smoke detector device of claim 1, wherein the air movement device includes a wax material for use in a self-test procedure.

5. The smoke detector device of claim 4, wherein the wax material is heated and the wax material becomes airborne during the self-test procedure.

6. A smoke detector device, comprising:
- a first smoke detecting chamber formed therein to receive particulate;
- a first light source directing a first light beam through the first smoke detecting chamber;
- a first light sensor to receive a portion of the first light beam and analyze the received first light beam to determine whether particles are present in the first smoke detecting chamber;
- an air movement device to move at least some of the particulate into an inlet of a second smoke detecting chamber;
- a filter material sized to filter particulate larger than a smoke particle and positioned such that the particulate must pass through the filter material to enter a second smoke detecting chamber thereby restricting passage of particles larger than smoke particles through the filter material;
- the second smoke detecting chamber formed therein to receive particulate from the first smoke detecting chamber;
- a second light source directing a second light beam through the second smoke detecting chamber; and
- a second light sensor to receive a portion of the second light beam and analyze the received second light beam to determine whether smoke particles are present in the second smoke detecting chamber.

7. The smoke detector device of claim 6, wherein the filter material is sized to not allow particles larger than 3 microns to pass through the filter material.

8. The smoke detector device of claim 6, wherein the filter material is sized to not allow dust particles to pass through the filter material.

9. The smoke detector device of claim 6, wherein the filter material is sized to not particles larger than 10 microns to pass through the filter material.

10. The smoke detector device of claim 6, wherein the filter material is sized to not allow insects to pass through the filter material.

11. The smoke detector device of claim 9, wherein the smoke detector device includes a tube between the first detecting chamber and the second detecting chamber with the filter material provided within the tube.

12. The smoke detector device of claim 9, wherein the smoke detector device includes a tube between the air movement device and the second detecting chamber with the filter material provided within the tube.

13. The smoke detector device of claim 9, wherein the smoke detector device includes a tube between the first detecting chamber and the second detecting chamber with the filter material provided within the tube and wherein the air movement device is connected to the second detecting chamber and pulls the particulate from the first detecting chamber toward the second detecting chamber.

14. The smoke detector device of claim 9, wherein the smoke detector device includes a tube between the first detecting chamber and the second detecting chamber with the filter material provided within the tube and wherein the air movement device is positioned in the first detecting chamber and directs the particulate from the first detecting chamber toward the second detecting chamber.

15. A smoke detector device, comprising:

a first smoke detecting chamber formed therein to receive particulate;

a first light source directing a first light beam through the first smoke detecting chamber;

a first light sensor to receive a portion of the first light beam and analyze the received first light beam to determine whether particles are present in the first smoke detecting chamber;

an air movement device provided in the first detecting chamber to move at least some of the particulate into an inlet of a second smoke detecting chamber;

a filter material positioned such that the particulate must pass through the filter material to enter a second smoke detecting chamber;

the second smoke detecting chamber formed therein to receive particulate from the first smoke detecting chamber;

a second light source directing a second light beam through the second smoke detecting chamber; and a second light sensor to receive a portion of the second light beam and analyze the received second light beam to determine whether smoke particles are present in the second smoke detecting chamber.

16. The smoke detector device of claim 15, wherein the air movement device is connected to a first end of a first tube through which particulate is directed toward the second detecting chamber.

17. The smoke detector device of claim 16, wherein a second end of the first tube is connected to a filtering chamber where the filtering material is positioned.

18. The smoke detector device of claim 17, wherein a first end of a second tube is connected to the filtering chamber to allow particulate small enough to pass through the filter material to move toward the second detecting chamber.

19. The smoke detector device of claim 18, wherein a second end of the second tube is connected to the second detecting chamber to allow particulate to move from the second tube into the second detecting chamber.

20. The smoke detector device of claim 15, wherein the smoke detector device includes a self-test apparatus that generates self-test particulate and wherein the smoke detector device includes a controller having a processor and memory and wherein the memory includes instructions executable by the processor to test continued functioning of the filter by checking for blockages through passing self-test test particulate through the filter to the secondary detection chamber to determine if the second light sensor can sense a threshold amount of self-test particulate.

* * * * *